United States Patent [19]

Foster

[11] 4,319,462

[45] Mar. 16, 1982

[54] REFRIGERATION SYSTEM FOR HEAT EXCHANGERS SUCH AS USED IN ICE RINKS AND THE LIKE

[76] Inventor: Arnold H. V. Foster, 85 - 22nd St. East, Prince Albert, Saskatchewan, Canada

[21] Appl. No.: 148,980

[22] Filed: May 12, 1980

[30] Foreign Application Priority Data

May 22, 1979 [CA] Canada ..... 328216

[51] Int. Cl.[3] ..... A63C 19/10

[52] U.S. Cl. ..... 62/235; 62/434

[58] Field of Search ..... 62/235, 434

[56] References Cited

U.S. PATENT DOCUMENTS 1,507,592 9/1924 Funk et al. ..... 62/235

2,722,108 11/1955 Hailey ..... 62/434

2,726,658 12/1955 Chessey ..... 62/434

3,156,101 11/1964 McGuffey ..... 62/434

*Primary Examiner*—Ronald C. Capossela

*Attorney, Agent, or Firm*—Stanley G. Ade

[57] ABSTRACT

Liquid refrigerant is pumped through the heat exchanger in the rink field or the like, on demand, and back to the evaporator. Any vapor is pumped through the compressor to an externally situated air cooled condenser and back to the evaporator thus maintaining the liquid phase. When the external condenser is in an ambient temperature, a predetermined amount below the temperature of the heat exchanger, the compressor shuts off and the liquid refrigerant is circulated by a liquid pump directly through the condenser and back to the evaporator to cool down the liquid refrigerant thus saving considerably on running costs inasmuch as the compressor is not used.

9 Claims, 1 Drawing Figure

10
11
12
13
14
15
16
17
18
18A
18B
19
20
21
22
23
24
25
26
27
28
29
30
31
32
33
34
35
36
37
38
39
40
41
42
43
44
45

REFRIGERATION SYSTEM FOR HEAT EXCHANGERS SUCH AS USED IN ICE RINKS AND THE LIKE

BACKGROUND OF THE INVENTION

This invention relates to new and useful improvements in refrigeration systems for heat exchangers such as those that might be used in ice rinks or the like and although an ice rink is mentioned in the present description, it should be appreciated that the system can be used in any environment where a heat exchanger is used to lower the temperature of the environment.

Under normal conditions, refrigerants are normally used which employ indirect cooling. For example, refrigerants which are used to cool brine or air and then the brine or air is used to cool the medium that it is desired to cool. Relatively large horsepowers are required under these circumstances and efficiency is substantially reduced.

SUMMARY OF THE INVENTION

The present invention relates generally to an improved system or technique for providing refrigeration to a medium to be cooled without having to run the compressor providing the outside ambient temperature is a predetermined amount cooler than the medium to be cooled. Examples are skating rinks or curling rinks, refrigerated store equipment, air conditioners or the like. The present device is designed to utilize low outside temperatures which are available in many parts of Canada and the United States, for example, to indirectly cool whatever medium is required to be cooled. As an example, an office building may be maintained at a temperature of 70° F. with the outside ambient air temperature being at 55° F. Excess heat is generated in the building due to lights and people load, etc., so that a large air conditioner has to be operated. With the present device, only the liquid pump would operate thus saving the power needed to run the conventional compressor. The same principle applies to skating and curling rinks, for example.

It is a further intention of this system to use the liquid pump to circulate the liquid refrigerant to the heat exchanger to be cooled although it is apparent that other means may be employed.

In accordance with the invention, there is provided a refrigeration system for cooling a heat exchanger in a medium to be cooled such as an ice rink or the like, comprising in combination an evaporator, a compressor, and an externally situated condenser operatively connected to said heat exchanger, means to circulate liquid refrigerant from said evaporator, through said heat exchanger and back to said evaporator on demand, means selectively to route refrigerant vapor from said evaporator through said compressor and said condenser and back to said evaporator to change said vapor to liquid and means to selectively pump liquid refrigerant from said evaporator through said condenser and back to said evaporator when the ambient temperature around said condenser is a predetermined amount below the ambient temperature of said heat exchanger in order to cool down said liquid refrigerant.

A further aspect of the invention provides a two-stage refrigeration system for a heat exchanger in a medium to be cooled such as an ice rink or the like, comprising in combination an evaporator operatively connected to the inlet side of said heat exchanger, pump means to drive refrigerant liquid from said evaporator through said heat exchanger and back to said evaporator, refrigerant carrying lines operatively connecting between said evaporator, said pump and said heat exchanger and a compressor for refrigerant gas and an externally situated condenser both operatively connected to said evaporator, said compressor compressing said refrigerant gas and pumping same through said condenser and back to said evaporator, refrigerant gas and liquid carrying lines operatively connecting said evaporator, said compressor and said condenser and an alternate routing for refrigerant liquid when the ambient temperature of said condenser is below a present figure, said alternate routing including an alternate line extending from the line between said evaporator and said inlet side of said field, and said condenser and valve means in said alternate line.

Another advantage of the present invention is to provide a system of the character herewithin described which permits the saving of considerable running costs under certain conditions.

Still another advantage of the invention is to provide a system of the character herewithin described which is simple in construction, economical in manufacture and operation, and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DETAILED DESCRIPTION

Figure 1:
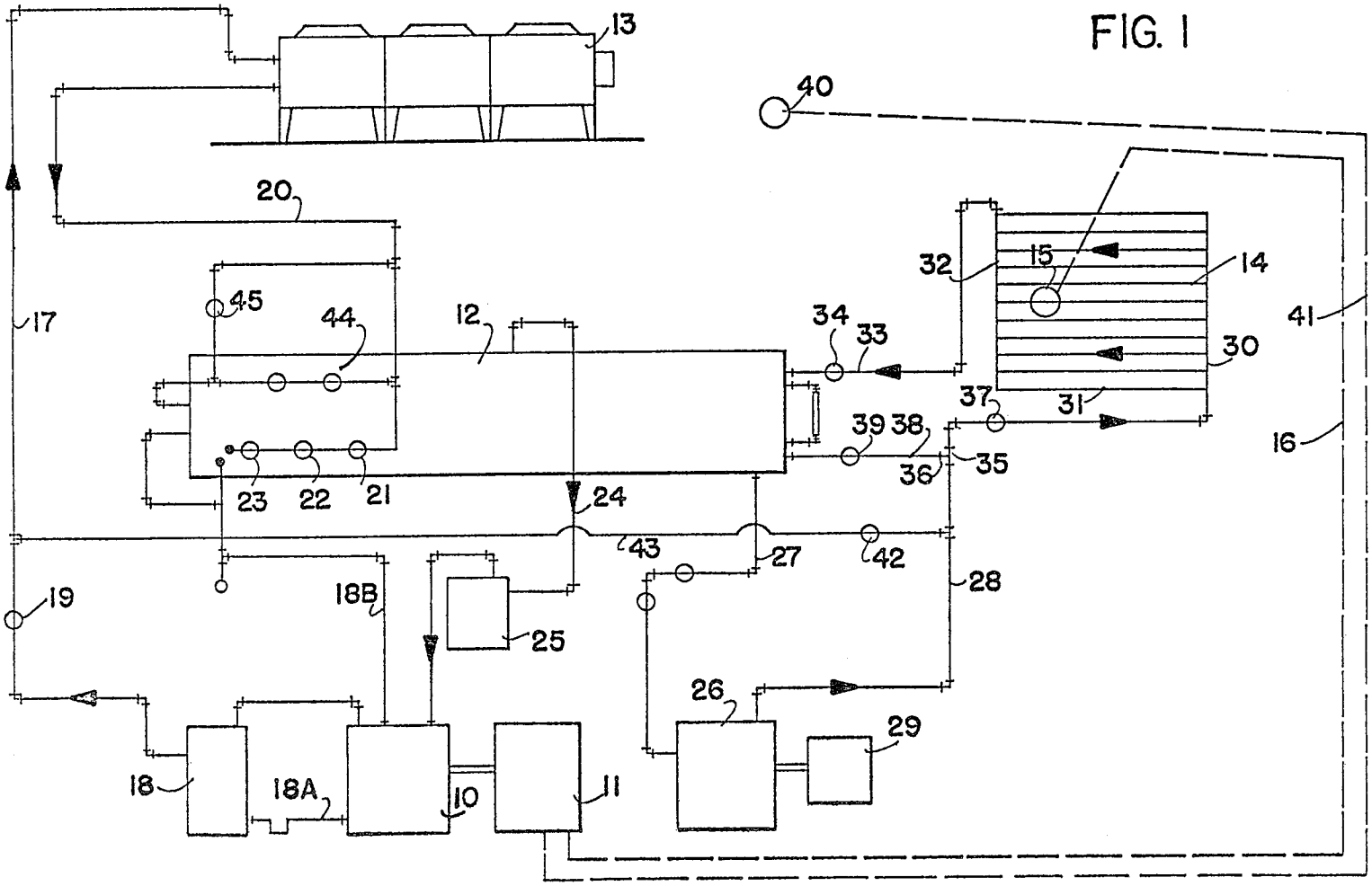
FIGURE 1 is a schematic view of the refrigeration system.

The system illustrated in FIGURE 1 contains many conventional components such as a compressor 10 driven by a source of power such as an electric or gasoline motor 11, an evaporator 12, a condenser 13 and a heat exchanger 14 which, in the present embodiment, is shown schematically as being situated within an ice rink field and consists of a flooded evaporator system.

An adjustable thermostat 15 controls the demand of the refrigerant to the ice field 14 through control of the motor 11 as shown by dotted line 16. In other words, when thermostat 15 is open, the motor is off and when the thermostat 15 is closed, the motor is on.

In the conventional mode, the compressor 10 delivers a conventional refrigerant such as Freon 22 (trade mark) to a main conduit 17 after passing through a conventional oil separator 18 which returns separated oil to the compressor via the return line 18A. The compressor pumps the refrigerant in the gaseous phase through line 17 to the condenser 13 with check valve 19 being provided in the line just beyond the outlet from the oil separator 18.

The condenser 13, under normal circumstances, transforms the gaseous refrigerant, into the liquid phase giving off heat in the usual way and this liquid refrigerant is then transmitted to the evaporator via line 20 through various valves and controls. In the present system, the liquid refrigerant passes through a filter dryer 21 to remove moisture and small dust particles, and then through a refrigerant expansion device or pressure reducing device 22 where the refrigerant normally starts changing from the liquid to the gaseous phase within the evaporator 12.

Reference character 23 illustrates a ball valve or shut off valve used for purposes of pump down or isolation of parts of the system.

After the refrigerant enters the evaporator 12 where it is boiled off at low temperatures, the refrigerant vapor is drawn back to the compressor 10 via line 24 from the top of the evaporator, through an accumulator 25 to be re-compressed by the compressor thus completing the cycle.

It should be pointed out that although only one set of components is shown, it will be appreciated that one or more compressors can be used with the system as well as one or more of all the other components.

Since most refrigerant hydrocarbons such as Freon 22 are completely miscible or compatible with the oils used to lubricate the compressor, it is frequently desirable to provide a bleed line to continuously separate the oil from the refrigerant and as well as line 18A illustrated, a further line 18B is shown extending from the evaporator to the compressor. Not shown are pressure gauges or thermometer indicators which are usually installed for purposes of uniform operation although they are not essential to the operation of the system.

The above explanation covers the refrigeration cycle which is basically similar to all other refrigeration equipment. However, the evaporator 12 which is approximately half full of low temperature liquid Freon 22, acts as a container whereby a liquid pump 26 pumps liquid refrigerant from the evaporator through line 27, through the pump 26 and thence to the main liquid refrigerant delivery line 28. A soure of power such as an electric motor or gasoline engine 29, may operate the pump 26 as will hereinafter be described.

The line 28 conveys the liquid refrigerant to the area or zone requiring cooling. In the present instance, it leads to a header 30 of an ice rink field 14 consisting of a plurality of lines 31. The liquid refrigerant then passes to the outlet header 32 and thence back to the evaporator by means of the return conduit or line 33 via ball valve 34. Note should be taken of the T-junction 35, a further T-junction 36 and ball valve 37 in the main delivery line 28. T-junction 36 is connected to a bypass conduit 38 to the evaporator via pressure release valve 39 provided for safety purpose.

The headers 30 and 32 together with line 14, in a typical installation such as an ice field, may be formed from steel or plastic in the usual way.

This is the circulation of liquid refrigerant provided when thermostat 15 is closed and is demanding refrigeration.

An adjustable ambient temperature thermostat 40 is provided adjacent the condenser 13 and controls the operation of the motors 11 and 29, as shown by dotted line 41.

As mentioned previously, when the thermostat 15 is in the closed position and thermostat 40 is also in the closed position, the invention changes radically from conventional refrigeration systems.

When the thermostats are in the above mentioned positions and due to the electrical connection via lines 16 and 41, the compressor 10 cannot operate.

However, thermostat 15 can still demand refrigeration and operate the liquid pump 26 so that the liquid refrigerant is pumped from pump 26 through line 28 to the field. At the same time, a proportion of this liquid refrigerant is bypassed through the T-valve 35 and through a valve 42 which is open due to pressure build-up, when the thermostat 40 is in the closed position. This bypass liquid refrigerant passes through a conduit 43 to the aforementioned conduit 17 downstream of check valve 19 and thence to the condenser 13 whereby it is cooled and returned to the evaporator 12 through conduit 20 to a solenoid valve 44 which was also opened by the closing of thermostat 40. The liquid then passes to the evaporator 12.

Therefore, by presetting thermostat 40 to any desired setting approximately 10° F. below the medium to be cooled, the outside air temperature or ambient temperature surrounding condenser 13, can be used to cool the refrigerant liquid and the refrigerant liquid in turn is used to cool the ice field 14 or the like thus saving the relatively high cost of operating the refrigerant compressor 10.

It should be stressed that valve 42 and a liquid refrigerant bypass valve 45 are important elements in the operation of the new system.

Valve 42 allows the liquid refrigerant to enter into the air cooled condenser 13 and valve 45, which allows liquid refrigerant in the condenser to be dumped quickly into the evaporator 12 upon start up of the compressor. This allows the condenser to return to the gaseous phase.

Although other methods can be used instead of valves 42 and 45, the end results remains the same namely that the air cooled condenser can rapidly be converted from a condenser which operates when the refrigerant is in the gaseous phase to a straight forward heat exchanger when the refrigerant is in the liquid phase.

The efficiency of the present system is apparent since the degree of efficiency of the compressor device is related at least in part, to the entering refrigerant temperature differential existing across the compressor so that the present system is one capable of higher capacities per horsepower than conventional systems.

Although Freon 22 has been mentioned, nevertheless other refrigerants can, of course, be used such as other Freons, ammonia, and brines and refrigerants such as Glycol, calcium or sodium chloride, and could utilize the same principle of bypassing the above substances to a condensor or heat exchanger which is located at a lower ambient temperature.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A refrigeration system for cooling a flooded evaporator system in a medium to be cooled such as an ice rink or the like, comprising in combination an evaporator, a compressor, and an externally situated condenser operatively connected to said flooded evaporator system, means to circulate liquid refrigerant from said evaporator, through said flooded evaporator system and back to said evaporator on demand, means selectively to route refrigerant vapor from said evaporator through said compressor and said condenser and back to said evaporator to change said vapor to liquid and means to selectively pump liquid refrigerant from said evaporator through said condenser and back to said evaporator when the ambient temperature around said condenser is a pre-determined amount below the ambient temperature of said flooded evaporator system in order to cool down said liquid refrigerant.

2. The system according to claim 1 in which said first means includes a refrigerant line operatively extending between said evaporator and said flooded evaporator system, a further refrigerant line operatively extending between said first line and said condenser and valve means in said second line selectively connecting said first line to said condenser, a return refrigerant line from said condenser to said evaporator and a solenoid valve in said return line operatively and selectively connected to said evaporator.

3. The system according to claim 1 which includes an externally situated, adjustable, thermostat operatively connected to said system to select the routing of refrigerant vapors through the compressor to said condenser and the routing of said refrigerant liquid directly through said condenser.

4. The system according to claim 2 which includes an externally situated, adjustable, thermostat operatively connected to said system to select the routing of refrigerant vapors through the compressor to said condenser and the routing of said refrigerant liquid directly through said condenser.

5. A two-stage refrigeration system for a flooded evaporator system in a medium to be cooled such as an ice rink or the like, comprising in combination an evaporator operatively connected to the inlet side of said flooded evaporator system, pump means to drive refrigerant liquid from said evaporator through flooded evaporator system and back to said evaporator, refrigerant carrying lines operatively connecting between said evaporator, said pump and said flooded evaporator system and a compressor for refrigerant gas and an externally situated condenser both operatively connected to said evaporator, said compressor compressing said refrigerant gas and pumping same through said condenser and back to evaporator, refrigerant gas and liquid carrying lines operatively connecting said evaporator, said compressor and said condenser and an alternate routing for refrigerant liquid when the ambient temperature of said condenser is below a preset figure, said alternate routing including an alternate line extending from the line between said evaporator and said inlet side of said field, and said condenser and valve means in said alternate line.

6. The system according to claim 5 which includes means to operate said condenser to receive liquid refrigerant when the ambient temperature around said condenser is a predetermined amount below the temperature of said flooded evaporator system and to operate said condenser to receive gaseous refrigerant when said ambient temperature around said condenser is a predetermined amount above said flooded evaporator system.

7. The system according to claim 6 in which said first mentioned means includes a line between said flooded evaporator system inlet and said condenser, and valve means in said last mentioned line, said line between said condenser and said evaporator including a solenoid valve which, when opened, directs liquid refrigerant directly from said condenser to said evaporator and which, when closed, bypasses refrigerant gas from said condenser to said evaporator.

8. The system according to claims 1, 2 or 3 which includes a compressor for refrigerant gas, to pump said gas from said evaporator to said condenser and a liquid pump for refrigerant liquid to pump said liquid from said evaporator to said flooded evaporator system and back to said evaporator.

9. The system according to claims 4, 5 or 6 which includes a compressor for refrigerant gas, to pump said gas from said evaporator to said condenser and a liquid pump for refrigerant liquid to pump said liquid from said evaporator to said flooded evaporator system and back to said evaporator.

* * * * *